US005242356A

United States Patent [19]

Grenfell

[11] Patent Number: 5,242,356

[45] Date of Patent: Sep. 7, 1993

[54] EXERCISE AND TONING APPARATUS

[76] Inventor: Hugh W. Grenfell, Amberley, 11 Maes-y-Bryn, Morriston, Swansea, SA6 6HE, United Kingdom

[21] Appl. No.: 809,549

[22] PCT Filed: Jun. 4, 1990

[86] PCT No.: PCT/GB90/00865

§ 371 Date: Jan. 28, 1992

§ 102(e) Date: Jan. 28, 1992

[87] PCT Pub. No.: WO90/14865

PCT Pub. Date: Dec. 13, 1990

[30] Foreign Application Priority Data

Jun. 7, 1989 [GB] United Kingdom ..... 8913110.6
Oct. 16, 1989 [GB] United Kingdom ..... 8923286.2

[51] Int. Cl.[5] ..... A63B 26/00

[52] U.S. Cl. ..... 482/142; 482/147; 128/25 R

[58] Field of Search ..... 482/142, 147, 146; 128/25 R

[56] References Cited

U.S. PATENT DOCUMENTS

| | | | |
|---|---|---|---|
| 2,707,465 | 5/1955 | Nemeth | 482/146 |
| 3,088,733 | 5/1963 | Ayres | 482/146 |
| 3,713,653 | 1/1973 | Romans | 482/146 |
| 3,911,907 | 10/1975 | Smith, Jr. | 128/25 R |
| 4,290,601 | 9/1981 | Mittelstadt | 482/146 |
| 4,538,807 | 9/1985 | Rice | 482/147 |
| 4,673,180 | 6/1987 | Rice | 482/147 |
| 4,848,742 | 7/1989 | Lindley et al. | 482/146 |
| 4,905,944 | 3/1990 | Hartz | 482/146 |
| 4,930,771 | 6/1990 | Wilson | 482/147 |
| 4,946,160 | 8/1990 | Bertoletti | 482/146 |

*Primary Examiner*—Richard J. Apley
*Assistant Examiner*—Lynne A. Reichard
*Attorney, Agent, or Firm*—Edwin D. Schindler

[57] ABSTRACT

An apparatus for exercising and/or toning the muscles of the waist, hips and thighs of a user, comprises an e.g. circular support (1) for the user to sit upon, the support (1) resting at its center on a mount (2) which enables the support to tilt in selected radial directions relative to a vertical axis. The support (1) may be arranged so that its periphery rests on a base (3) and the point of contact between the support (1) and a base (3) moves in a circle around the base as the user causes the direction of tilt to progress around in a circle by a circular movement of the hips. In a modified apparatus a drive means is provided to cause the direction of tilt of the support to progress around in a circle.

2 Claims, 2 Drawing Sheets

EXERCISE AND TONING APPARATUS

This invention relates to an apparatus for exercising and/or toning the muscles of the waist, hips thighs of a user.

In maintaining a slim, athletic figure, it is highly desirable to exercise the muscles of the waist, hips and thighs, but most exercise machines fail to exercise these muscles. These muscles lose tone and are prone to atrophy in advancing years. The muscles of the waist and hips receive very little exercise from normal bodily movements.

In accordance with this invention, there is provided an apparatus for exercising and/or toning the muscles of the waist, hips and thighs of a user, comprising a support for sitting upon, the support resting at its centre on a mount which enables the support to tilt in selected radial directions relative to a vertical axis.

The support may be freely mounted so that it will tilt in any radial direction. In particular, a user may sit on the support and then by appropriate circular movement of the hips, cause the direction of tilt to progress around in a circle. For example the support may be circular and arranged so that its periphery rests on a base, the point of contact between the circular support and the base moving in a circle around the base as the hips describe their circular movement.

This apparatus exercises the sacro-iliac joint, being the joint between the base of the spine and the pelvis, and in so doing exercises the muscles of the waist, hips and thighs as well as other posture muscles in the abdomen and back.

The apparatus may include drive means for causing the direction of tilt of the support to progress around in a circle. This apparatus then serves to tone the muscles mentioned above. Such apparatus may include a circular support arranged so that its periphery rests on a base, the point of contact between the circular support and the base moving in a circle around the base in response to the action of the drive means. Instead the support may be mounted at a fixed angle of tilt to an upright drive shaft, so that the direction of tilt of the support progresses around in a circle.

Embodiments of this invention will now be described by way of examples only and with reference to the accompanying drawings, in which.

Figure 1:
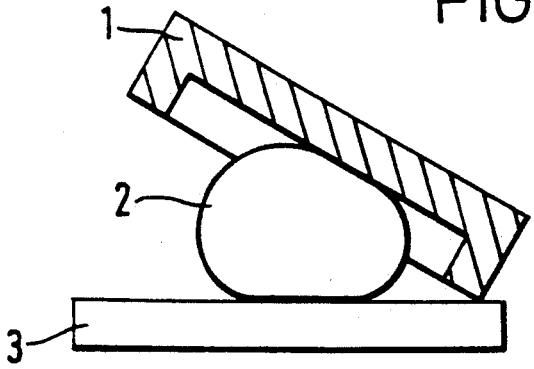
FIG. 1 is a diagrammatic cross-section through an exercise apparatus in accordance with this invention.

Referring to FIG. 1, there is shown an exercise apparatus which comprises a circular support 1 in the shape of a flat plate preferably having a perhipheral rim projecting from its underside. The apparatus further comprises a flat base 3 and a ball 2 is disposed between the base 3 and circular support 1. The support 1 rests at its centre on the ball 2 at an angle of tilt such that its rim rests on the base 3. The ball may be attached to the support 1 and base 3 and is preferably of a resiliently deformable material.

In use, the person wishing to exercise sits on the circular support 1 and then causes the hips to describe a circular movement so that the point of contact between the rim of the support 1 and the base 3 progresses in a circle around the base, the direction of tilt of the support 1 similarly progressing in a circle. The angle of tilt may be up to 30°, typically.

Figure 3:
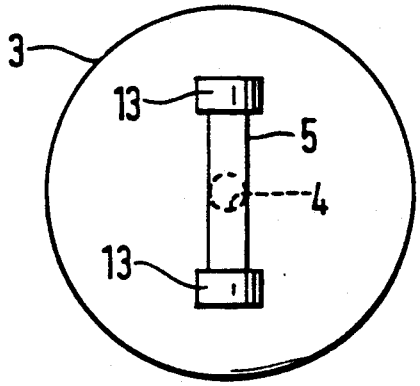
FIG. 3 is a plan view of the apparatus of FIG. 2 with its circular support removed.
Figure 2:
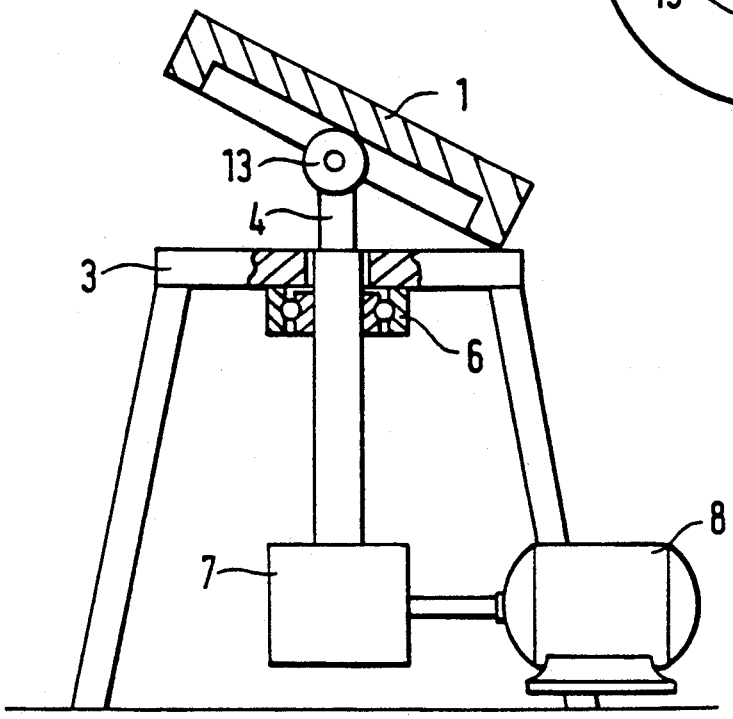
FIG. 2 is a diagrammatic cross-section through a toning apparatus in accordance with this invention.

The apparatus shown in FIGS. 2 and 3 is for toning the muscles and for this purpose includes a drive motor for causing the direction of tilt of the circular support 1 to progress in a circle. The apparatus has the base 3 with which the rim of the circular support makes contact, but the support 2 is mounted across a diameter on a pair of rollers 13 at either end of a cross-piece 5 which is fixed to the top end of a vertical shaft 4. This shaft 4 passes through the centre of the base 3, where it is mounted in a bearing 6. An electric drive motor 8 rotates the shaft 4 via a gear box 7, so that the cross-piece 5 turns and causes the direction of tilt of the circular support 1 to progress around in a circle.

In each apparatus described above, the user may sit on the support 1 for exercising and/or toning the waist, hips and thigh muscles, or may stand on the support for exercising the muscles of the lower legs and ankles (particularly the anterior tibials and the peroneals).

The apparatus may also be arranged for the support 1 and base 3 to lie vertically. The user can then lie on his back with the feet elevated above the body and resting on the support 1. Exercise or toning in this position helps to remove any fluid collecting at the ankles and feet.

Figure 5:
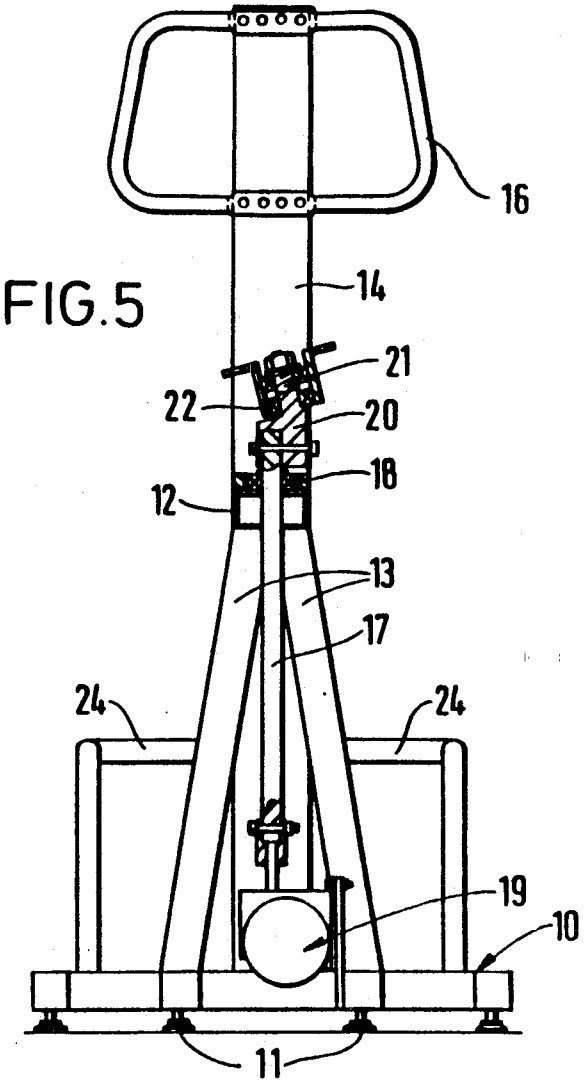
FIG. 5 is a section on the line A—A through the apparatus of FIG. 4.
Figure 4:
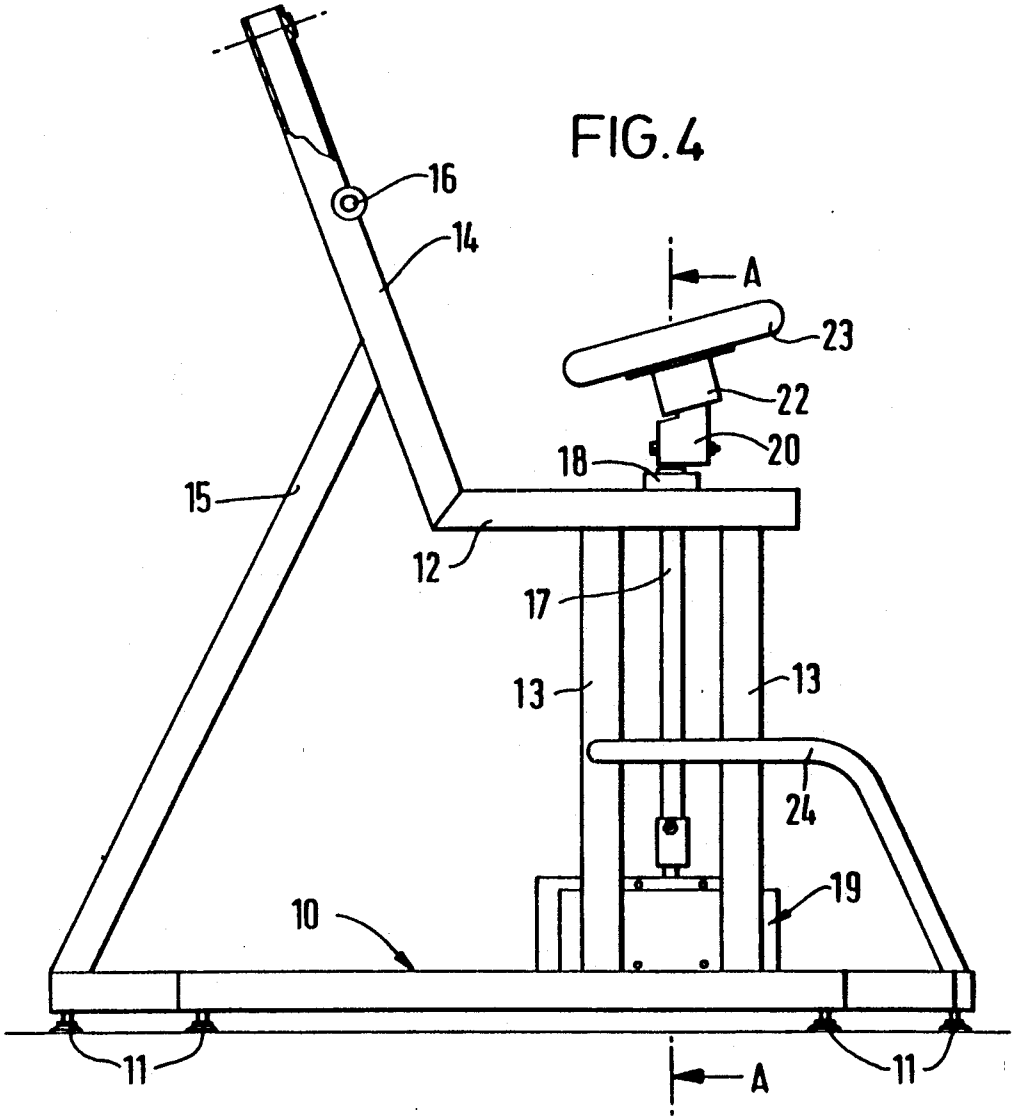
FIG. 4 is a side elevation of another embodiment of toning apparatus.

FIGS. 4 and 5 show another embodiment of toning apparatus. The apparatus has a base frame 10 which rests on the ground by means of adjustable feet 11. A horizontal frame member 12 running in the front-to-rear direction is supported at the front end and middle by two pairs of inclined upright members 13. From the rear end of member 12 a member 14 extends upwardly and rearwardly an an incline and is supported on an inclined upright member 15. A rectangular or trapezium shaped frame 16 is mounted to the member 14 and acts as handlebars. A vertical shaft 17 passes through the member 12 and is journalled in a bearing 18: an electric motor 19 is mounted to the frame 10 to drive the shaft via gearbox. A unit 20 is fixed to the upper end of shaft 17 and has an upwardly-directed shaft 21 inclined to the vertical and receiving a bearing 22 to which a support 23 is fixed.

The user climbs onto the apparatus to sit on the support 23, facing and holding onto the handlebars: bars 24 are provided either side of the apparatus for stepping on in climbing onto the apparatus, but thereafter the user drops the legs to hang freely. Then the motor is started and the upright shaft 17 rotates: in so doing the angle of inclination of the support or seat 23 progresses around in a circle, but the seat 23 maintaining its general orientation (as seen in plan view) because of frictional engagement by the user sitting on it, and the fact that the inclined shaft 21 is free to turn in the bearing 22.

I claim:

1. An apparatus for exercising the sacro-iliac joint and the muscles of the waist, hips and thighs of a user, said apparatus comprising:

a support for a user to sit upon with the legs of the user hanging freely;

a mount for supporting said support at its center for enabling said support to tilt in selected radial directions relative to a vertical axis;

fixed handlebar means for the user to face and hold onto when sitting upon said support; and, means for freely rotatably mounting said support at its center and a horizontal base, said support being circular and arranged so that its periphery rests on said horizontal base with a point of contact between said support and said horizontal base moving around said horizontal base in a circular path as the user causes the direction of tilt of said support to progress around in a circle.

2. An apparatus for exercising the sacro-iliac joint and the muscles of the waist, hips and thighs of a user, said apparatus comprising:

a support for a user to sit upon with the legs of the user hanging freely;

a mount for supporting said support at its center for enabling said support to tilt in selected radial directions relative to a vertical axis;

fixed handlebar means for the user to face and hold onto when sitting upon said support;

motor-driven means; and, means for freely rotatably mounting said support at its center and a horizontal base, said support being circular and arranged so that its periphery rests on said horizontal base with a point of contact between said support and said horizontal base moving around said horizontal base in a circular path as said motor-driven means causes the direction of tilt of said support to progress around in a circle.

* * * * *